US007322799B2

(12) United States Patent
Robertson et al.

(10) Patent No.: US 7,322,799 B2
(45) **Date of Patent: *Jan. 29, 2008**

(54) SCALABLE, MODULAR, HIGH AVAILABILITY FAN SYSTEM

(75) Inventors: Naysen J. Robertson, Orangevale, CA (US); Ricardo Ernesto Espinoza-Ibarra, Carmichael, CA (US); Sachin Navin Chheda, Roseville, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 700 days.

This patent is subject to a terminal disclaimer.

(21) Appl. No.: 10/699,430

(22) Filed: Oct. 31, 2003

(65) Prior Publication Data

US 2005/0095138 A1 May 5, 2005

(51) Int. Cl.
*F04B 49/00* (2006.01)

(52) U.S. Cl. ..... 417/16; 417/374; 417/423.1; 318/538

(58) Field of Classification Search ..... 417/16, 417/423.1, 374; 318/358
See application file for complete search history.

(56) References Cited

U.S. PATENT DOCUMENTS

| | | | | |
|---|---|---|---|---|
| 6,791,209 | B2 * | 9/2004 | Aldridge et al. | 307/65 |
| 6,956,344 | B2 * | 10/2005 | Robertson et al. | 318/538 |
| 2003/0122430 | A1 * | 7/2003 | Aldridge et al. | 307/64 |

FOREIGN PATENT DOCUMENTS

| | | | |
|---|---|---|---|
| EP | 0661186 | A | 7/1995 |
| EP | 1464109 | A | 7/2003 |
| GB | 2093149 | A | 8/1982 |
| JP | 06069673 | A | 8/1988 |

* cited by examiner

*Primary Examiner*—Anthony D. Stashick
*Assistant Examiner*—Leonard J Weinstein

(57) ABSTRACT

In one embodiment, the invention recites a fan motor assembly with integrated redundant availability. The fan motor assembly comprises a fan motor subassembly with a plurality of replaceable fan motors, and a fan motor selector mechanism coupled to the fan motor subassembly, so that the fan motor selector mechanism selectively engages one of the plurality of replaceable fan motors to a fan. The fan motor assembly further comprises a control unit which is coupled to the fan motor selector mechanism which is configured to control the fan motor selector mechanism such that a first replaceable fan motor mechanically powers the fan while a second replaceable fan motor can be dynamically removed from the fan motor subassembly.

19 Claims, 5 Drawing Sheets

SCALABLE, MODULAR, HIGH AVAILABILITY FAN SYSTEM

TECHNICAL FIELD

Embodiments of the present invention relate to a method and apparatus for increasing the availability of a fan system via the use of redundant drive motors.

BACKGROUND ART

Electronic equipment often require extra cooling to transfer and dissipate the heat generated by the various components such as microprocessors, and the most commonly used mechanism for removing heat from a product such as a computer or server is a motor-driven fan. In a single-motor fan assembly, the motor is a single point of failure which can lead to system overheating. Typically, when this occurs it is necessary that a second fan be in place or that the failed motor be replaced in a short amount of time. Alternatively, the computer may continue operating, but at a reduced cooling capacity (e.g., reducing the processor speed to prevent overheating). Most fan failures are caused by motor failure.

Computers designed for high availability service, such as servers, add extra fans to compensate for the possibility of a fan failure. This prior art cooling system design paradigm increases the overall server cost in several ways: increased cost for an additional fan or fans, increased use of scarce real estate in the packaging with consequent limitations on design and layout options, increased design complexity (e.g., additional electrical power switching and logic for controlling/synchronizing the fans), and increased demand for power management subsystems. The need for additional space for the extra fan(s) will affect the thermodynamic cooling process, since the airflow will be different when driven from various locations in the packaging. When the fan system is configured so that two or more fans are in line axially, a further degradation of cooling effectiveness occurs because of the reduced airflow caused by the blockage of a failing or non-operating fan being in the airflow of the operating fan. In some cases, two fans may be operative at the same time, thus requiring synchronization systems. Thus the increased availability from prior art fan systems comes with various other costs, additional design burdens, or impairments to the overall product design.

Thus there is a need for a high availability fan system that minimizes real estate utilization in the equipment, recognizes that the motor is the high failure element in a fan system, facilitates easy replacement of a failed motor with minimal down time for the equipment, and provides the product designer with a less demanding set of packaging requirements. In cases where a higher degree of redundancy is required, there is a need for a design that provides for multiple replacement fan motors that are modular and scalable. These needs are met by embodiments of the present invention.

DISCLOSURE OF THE INVENTION

In one embodiment, the invention recites a fan motor assembly with redundant availability. The fan motor assembly comprises a fan motor subassembly with a plurality of replaceable fan motors, and a fan motor selector mechanism coupled to the fan motor subassembly, so that the fan motor selector mechanism selectively engages one of the plurality of replaceable fan motors to a fan. The fan motor assembly further comprises a control unit which is coupled to the fan motor selector mechanism which is configured to control the fan motor selector mechanism such that a first replaceable fan motor mechanically powers the fan while a second replaceable fan motor can be dynamically removed from the fan motor subassembly.

BRIEF DESCRIPTION OF THE DRAWINGS

The accompanying drawings, which are incorporated in and form a part of this specification, illustrate embodiments of the present invention and, together with the description, serve to explain the principles of the invention. Unless specifically noted, the drawings referred to in this description should be understood as not being drawn to scale.

MODES FOR CARRYING OUT THE INVENTION

Figure 1:
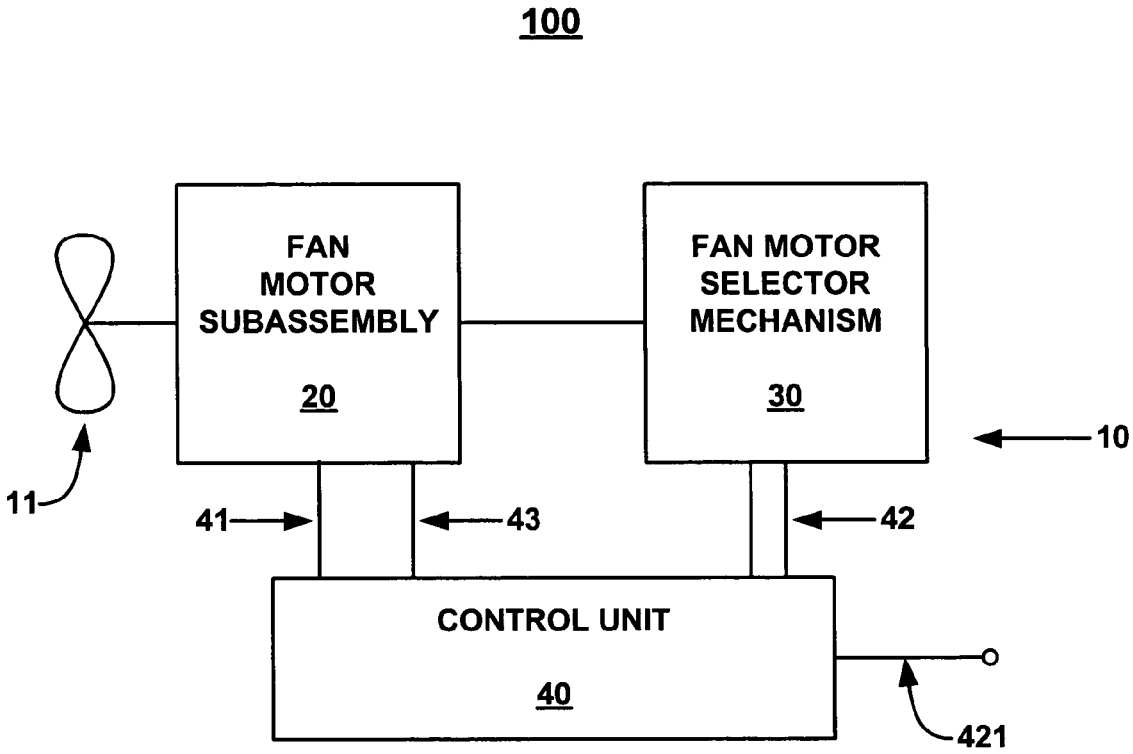
FIG. 1 shows a fan motor assembly with redundant availability, consisting of a fan motor subassembly, a fan motor selector mechanism, and a control unit in accordance with embodiments of the present invention.

Reference will now be made in detail to embodiments of the present invention, examples of which are illustrated in the accompanying drawings. While the present invention will be described in conjunction with the following embodiments, it will be understood that they are not intended to limit the present invention to these embodiments alone. On the contrary, the present invention is intended to cover alternatives, modifications, and equivalents which may be included within the spirit and scope of the present invention as defined by the appended claims. Furthermore, in the following detailed description of the present invention, numerous specific details are set forth in order to provide a thorough understanding of the present invention. However, embodiments of the present invention may be practiced without these specific details. In other instances, well-known methods, procedures, components, and circuits have not been described in detail so as not to unnecessarily obscure aspects of the present invention.

Embodiments of the present invention are directed to a redundant scalable high availability fan system. In embodiments of the present invention, a plurality of replaceable fan motors are disposed in a single fan motor subassembly. A selector mechanism, in response to signals from a control unit, controls the fan motor subassembly such that one of the fan motors provides power to the fan while a second fan motor can be dynamically removed from the fan motor subassembly. Because the fan motors are replaceable, the necessity to provide a mechanism for a replaceable fan assembly is not needed. Thus the placement of components in the ejection path of such an assembly is possible in embodiments of the present invention.

Embodiments of the present invention facilitate redundant cooling capability without the need for multiple fan assemblies. For example, a failing fan motor can be disengaged from the fan and replaced while a redundant motor takes up driving the fan, thus minimizing the impact to the normally sustained airflow within the system enclosure. In other words, reduced system performance and fan performance are minimized when a fan motor fails. Additionally, because there is no need for redundant fans, embodiments of the present invention enable reducing the cost, complexity, and bulk size of the cooling system.

In embodiments of the present invention, the fan system is scalable in that fan motors of different power capabilities can be integrated into a single fan motor subassembly. As a result, the fan speed and power usage of the cooling system can be controlled by selecting which fan motor is engaged with the fan. This also improves design flexibility by providing motor replacement options (e.g., upgrading or downgrading to more/less powerful motors) for example, during a field upgrade of heat generating components in an installed system. Additionally, the control unit can be programmed so that, for example, in periods when high heat loads are anticipated, the control unit can selectively engage a more powerful motor to the fan to provide increased cooling capacity. Furthermore, the ability to replace motors simplifies the process of leveraging an existing design to create a new product.

FIG. 1 shows an embodiment of a fan motor assembly 100 in accordance with the present invention. In the embodiment of FIG. 1, fan motor assembly 100 comprises a fan motor subassembly 20, a fan motor selector mechanism 30, and a control unit 40. The fan motor subassembly selectively couples one of at least 2 fan motors to the fan 11 via drive gears (not shown). The drive gears are mounted to the shafts of fan 11 and fan motors mounted on receptacles in fan motor subassembly 20 respectively. In embodiments of the present invention, the process of moving a failed motor to a disengaged position from the fan drive gear and the process of moving a replacement motor to an engaged position to drive the fan drive gear is accomplished simultaneously. In embodiments of the present invention, this is done using fan motor subassembly 20 that has receptacles for a multiplicity of fans. In embodiments of the present invention, fan motor subassembly 20 is scalable and may comprise 2 or more fan motors, according to the needs of a particular application.

Figure 2:
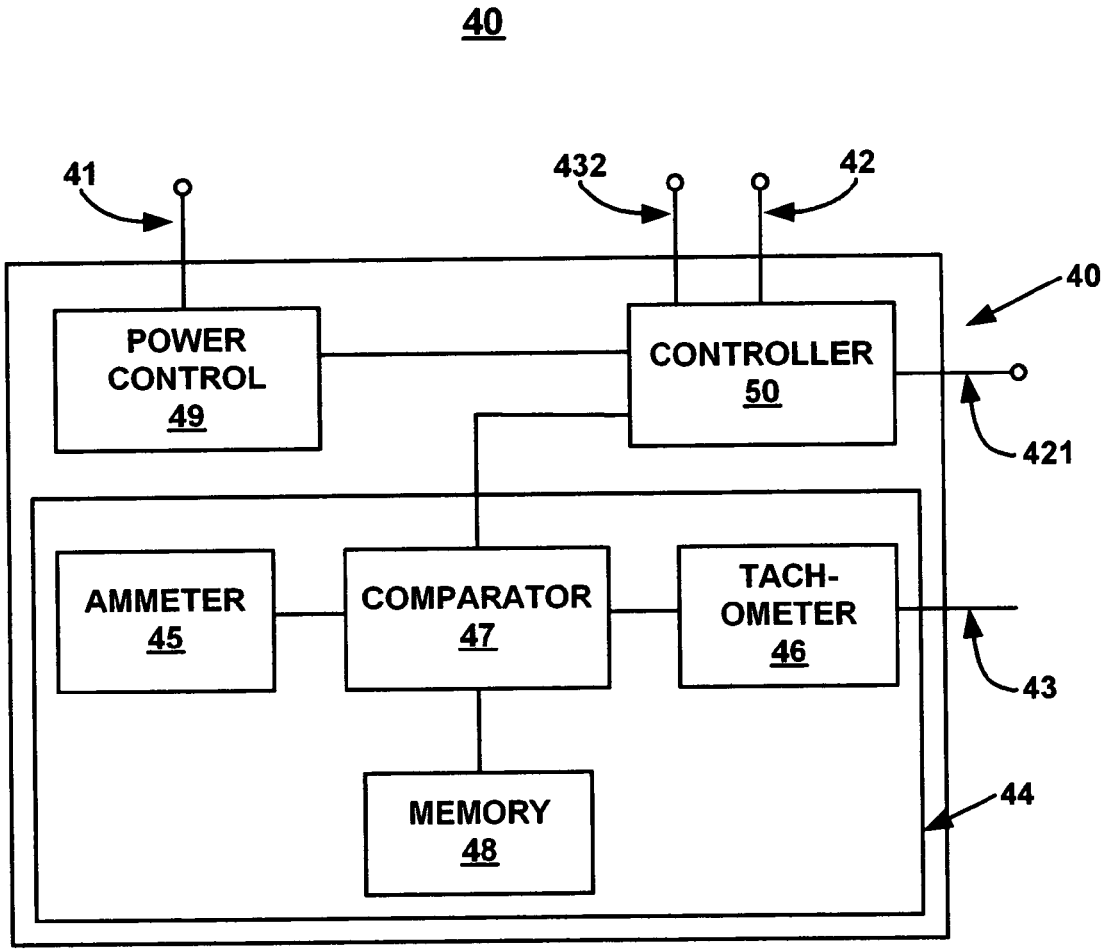
FIG. 2 shows a control unit for a high availability fan system in accordance with embodiments of the present invention.

FIG. 2 shows a control unit 40 for a high availability fan system in accordance with embodiments of the present invention. In embodiments of the present invention, control unit 40 monitors the performance of the active fan motor based upon the fan motor speed and/or the fan motor current drain of the active fan motor. While the present embodiment recites monitoring these performance parameters specifically, it is appreciated that other performance parameters may be monitored by control system 40 in embodiments of the present invention. In the present embodiment, when at least one of these performance metrics exceeds a threshold indicating either a failure condition, or the approach of a failure condition, control unit 40 activates a transfer wherein the failing motor is replaced by another motor. In one embodiment, control unit 40 shuts off power to the failing motor and initiates a command to the fan motor selector mechanism 30 to move the failing motor out of contact with the fan drive gear associated with fan 11 and simultaneously moves another motor into position so that its drive gear is engaged with the fan drive gear associated with fan 11.

In the embodiment of FIG. 2, control unit 40 comprises a performance-monitoring module 44, a controller 50, and a power control subsystem 49. In one embodiment, performance-monitoring module 44 comprises a current measuring device 45, and a tachometer 46 coupled with a comparator 47 and a memory 48. Tachometer 46 monitors, via coupling 43, the revolutions per minute of the currently engaged fan motor or of fan 11 itself, depending on where the tachometer sensor is located. In one embodiment, the measurement for tachometer 46 is measured from the shaft of fan 11. In the present embodiment, current for the active fan motor is conveyed from power control module 49 via coupling 41. Current measuring device 45 measures the current passing through the power control module 49 to the active and operating motor of fan motor assembly 100.

The measurements of fan motor performance are delivered to comparator 47 which then compares them with a set of stored performance metrics (e.g., stored in memory 48) that indicate either a failure condition, or the approach of a failure condition, of the currently engaged fan motor of fan motor assembly 100. It is appreciated that while the embodiment recites these performance parameters specifically, there are a variety of performance metrics that can be monitored by control unit 40 in embodiments of the present invention. Controller 50 monitors the results delivered from comparator 47, and delivers commands to the power control subsystem 49 and the fan selector mechanism 30 to initiate coupling a different fan motor with fan 11 when a failure condition is indicated.

In one embodiment, controller 50 may be a hardwired circuit for controlling fan motor selector mechanism 30 and power control 49 based upon signals from comparator 47. In another embodiment, controller 50 can be programmed by a user via connection 421 to selectively engage one of the fan motors to fan 11 according to, for example, anticipated system needs and can deliver status reports and accepts commands from a network (not shown) via a connection 421. In a similar manner, programming of the controller can be used to enable replacement schemes. For example, in a low noise environment, a lower power motor can be engaged with the fan to reduce ambient noise. Alternatively, in a high performance environment that might generate a higher heat load, a more powerful fan motor can be engaged with the fan.

In embodiments of the present invention, controller 50 comprises a microprocessor suitable for executing commands based on inputs received via connection 421, inputs from the comparator 47, and/or from normal initialization when first powered on. In one embodiment, memory 48 may also store executable instructions for controller 50. Additionally, controller 50 may can be designed to accept commands from a user via connection 421. This allows a user to select which motor is engaged with fan 11 according anticipated needs. For example, in periods of high anticipated heat loads, the user can program controller 50 to automatically engage a higher power motor with fan 11. During periods of lower anticipated heat loads, a lower power fan motor may be engaged.

In one embodiment, when the motor driving fan 11 begins to fail, the rotational speed measured by tachometer 46 falls below a specified level. In another embodiment, an increase/decrease in fan motor current drain above/below a specified threshold is used to trigger a transition from a first fan motor to a second fan motor. Either one or both metrics can be employed to deliver a failed condition signal from the comparator 47 to the controller 50. Upon receipt of such an indication of failure or incipient failure, the controller 50 initiates a series of commands (described earlier) to automatically effect a transition from the motor currently driving fan 11 to a replacement motor.

Figure 3:
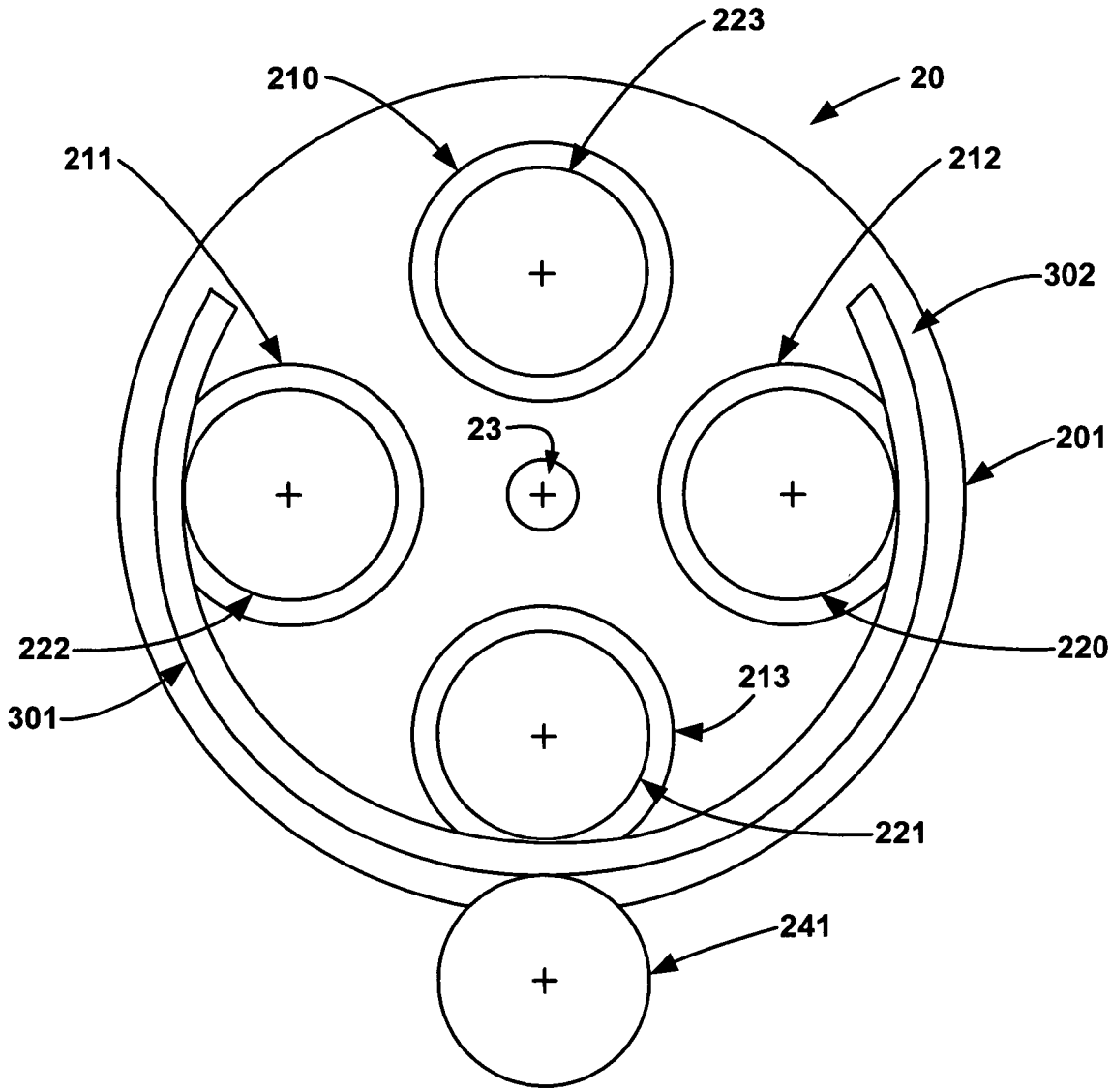
FIG. 3 shows an exemplary fan motor subassembly in accordance with embodiments of the present invention.

FIG. 3 shows an embodiment of fan motor subassembly 20 in accordance with the present invention. In the embodiment of FIG. 3, a four-motor subassembly comprising fan motors 210, 211, 212, and 213, and their associated fan drive gears 223, 222, 220, and 221 respectively. In embodiments of the present invention, the number of fans can range from 2 to N, depending on application requirements. In embodiments of the present invention, the fan motors can exhibit substantially identical performance characteristics, thus providing a redundant power source for the cooling system.

Additionally, some or all of the motors may exhibit different power characteristics (e.g., fan motor 210 is a 5 amp motor, fan motor 211 is a 10 amp motor, etc). This allows driving fan 11 at variable speeds by simply changing which fan motor is engaged with the fan. As a result, embodiments of the present invention may be utilized in such a way as to substitute or augment pulse width modulation (PWM) techniques. In other words, different speed/power-grade motors can be disposed in fan motor subassembly 20 to enable dynamic or static switching based upon predefined or regulated system requirements. For example, if the system has been installed in a hotter than average data center, a higher power motor can be engaged with fan 11 to move more are and thus provide greater cooling capacity. Under conditions in which system noise and power efficiency is an issue, a quieter, more power efficient fan motor can be engaged to fan 11. Additionally, the ability to replace motors without removal of the fan enclosure, or stopping the fan, allows for the upgrade of motors as needed. For example, to support an upgrade of processor cards which require additional cooling capacity, fan motors can be removed from fan motor assembly 20 and replaced with higher capacity fan motors. This replacement of fan motors can be accomplished without the need for interrupting power to fan 11.

In the present embodiment, two transport guides 301 and 302 are depicted in contact with fan motor drive gears 222 and 220. The transport guides comprise a suitable surface for providing a friction contact with the fan motor driver gear. For example, in embodiments of the present invention, transport guides 301 and 302 may be smooth, slightly roughened, or may have very short teeth or corrugations against which the fan motor drive gear can obtain traction. In the present embodiment, motor 213 is the active drive motor for fan 11 and is engaged with the fan drive gear 241 via drive gear 221. In embodiments of the present invention, fan drive gear 241 is directly coupled with the shaft upon which fan 11 rotates. In other embodiments, the fan motors can be coupled with fan 11 via, for example, a clutch mechanism, magnetic coupling, drive belts, a plurality of gears, etc.

While the embodiment of FIG. 3 shows the fan motors disposed in a circular manner, in embodiments of the present invention, fan motors 210, 211, 212, and 213 may be disposed in a different configuration than shown in FIG. 3. For example, fan motors 210, 211, 212, and 213 may be disposed in a linear configuration (e.g., horizontally or vertically).

In one embodiment, upon detection of failure or impending failure or motor 213, controller 40 initiates activation of the replacement process. In another embodiment, controller 40 initiates activation of the replacement process in order to vary the cooling capacity of fan motor assembly 100 by engaging a more or less powerful fan motor with fan 11. In the embodiment of FIG. 3, fan motor 212 is activated with relatively low power and/or low speed. Drive gear 220 of fan motor 212 is in contact with a transport guide 302 and, upon activation of fan motor 212, causes fan motor subassembly 20 to rotate clockwise around the axis of shaft 23. In so doing, fan motor 212 is rotated into position such that drive gear 220 engages fan drive gear 241. As the fan motor subassembly 20 rotates, drive gear 221 of fan motor 210 is simultaneously disengaged from fan drive gear 241. Thus the replacement fan serves as the drive mechanism for activating the automatic fan motor replacement action under the fan selector mechanism function. In the present embodiment, transport guides 301 and 302 are configured so that they do not interfere with the detent mechanism and the engagement process when a fan motor moves into position to engage the fan drive gear.

In embodiments of the present invention, a detent mechanism of fan motor selector mechanism 30 prevents fan motor subassembly 20 from overshooting the proper position for alignment and engagement of the drive gear 220 with the fan drive gear 241. Upon detecting that drive gear 220 is engaged with fan drive gear 241, controller 40 then initiates a command to power control subsystem 49 to activate the desired level of power to motor 212 to drive fan 11 at an appropriate speed. Detection of fan motor engagement may be determined by a variety of methods. For example, in one embodiment, detection of alignment is determined by use of a position sensor associated with the detent mechanism on the shaft 23. The position sensor may consist of a, electrical switch, a magnetic proximity system, etc. When the position sensor detects that the detent mechanism has successfully positioned the fan motor subassembly into the correct alignment, it signals such detection to the controller via connection 432 in FIG. 1 and FIG. 2. Alternatively, detection of alignment can be presumed by a simple timeout system in a subroutine in controller 50 that waits a suitable time after activation of the transport mode, assuming that a detent mechanism is also employed.

While the embodiment of FIG. 3 teaches that the direction of rotation of fan motor subassembly 20 is clockwise, in embodiments of the present invention, the direction of rotation may be counterclockwise, thus bringing fan motor 211 into position to drive the fan drive gear 241 via contact with transport guide 301. The transport guides 301 and 302 are shown to demonstrate the relationships between transport guide and fan motor gear. In embodiments of the present invention, the guides are mounted securely to a part of the fan motor subassembly 20. While two drive guides are shown in the present embodiment, it is appreciated that only one drive guide may be necessary in embodiments of the present invention.

In embodiments of the present invention, fan motor subassembly 20 comprises a circular frame with receptacles for mounting the fan motors disposed therein. In embodiments of the present invention, this frame can be realized with a wire mesh or other non-solid surface material to minimize air flow blockage. The receptacles and fan motors can be equipped with mating quick release retainer mechanisms well known in the arts, to facilitate easy installation and quick removal of fan motors. The wires for providing power to the fan motors can be similarly equipped with quick release connections to a suitable location on the body of the fan motor subassembly. For example, fan motor 210 and fan drive gear 223 can be removed from fan motor subassembly by lifting fan motor 210 up (e.g., in the direction away from fan motor 221). However, while fan motor 210 is being replaced, fan motor 221 can be engaged with and driving fan 11. Thus, there is no need to disengage power from fan 11 and/or reduce the cooling efficiency of the system while replacing a fan motor. Alternatively, fan motor 210 may be replaced by pushing/pulling the motor away from fan 11.

In another embodiment, a separate drive motor can be used to effect rotation of fan motor subassembly 20. Additionally, other configurations for the configuration and motion of the fan motor subassembly 20 are equally feasible.

For example, the motors could also be mounted in a linear array with each motor next to one another, in a horizontal (or vertical, or any other suitable direction) line. In this embodiment, each motor and its mounting system slides (horizontally) from a waiting position to the drive position; upon activation of the fan replacement process, the failed drive motor is slid out of the drive position into a disengaged position on the other side of the fan drive gear. Again, in this embodiment, the driving force that moves the replacement motor may be provided by the fan motor that is moving into the engaged position, or can be provided by an alternate source of power, such as another motor or an electromagnet system. Additionally, the drive motors may be moved using a belt drive, a chain drive, mechanical actuator, a separate transfer motor, electromagnetic force, etc. Thus, the arrangement of the fan motor subassembly can be configured to meet the packaging requirements of the device being cooled by the fan system in embodiments of the present invention.

Figure 4:
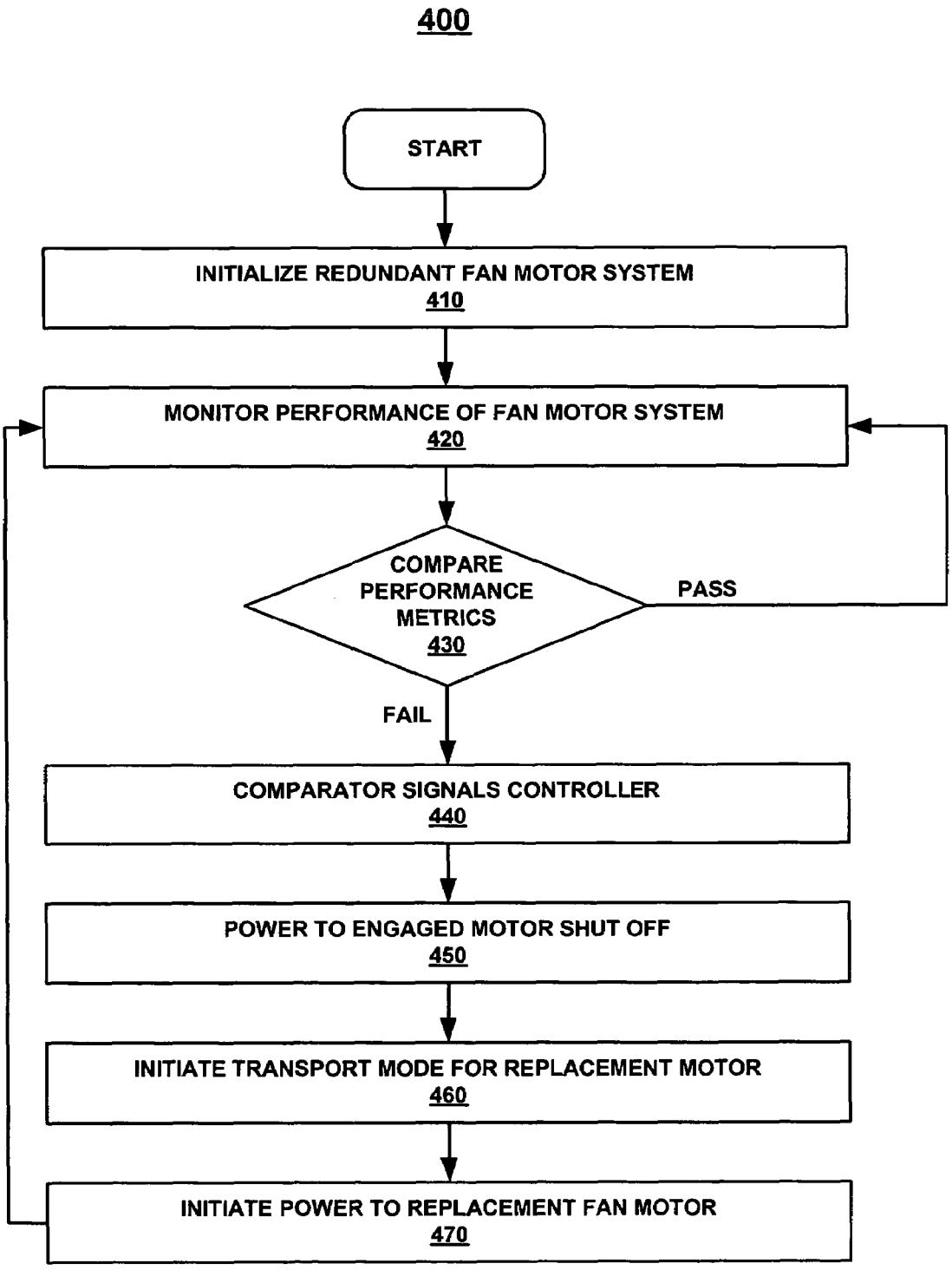
FIG. 4 is a flow chart of a method for providing redundant availability in a fan system in accordance with embodiments of the present invention.

FIG. 4 is a flow chart of a method 400 for providing redundant availability in a fan system in accordance with embodiments of the present invention. In step 410 of the present embodiment, the redundant fan motor system (e.g., fan motor assembly 100 of FIG. 1) is initialized (powered on). Control unit 40 automatically detects the active motor, either from the position determination system or from data stored in memory from the last time fan motor assembly 100 was powered on, or from a pre-arranged starting position (e.g., a pre-arranged sequence for fan replacement number assignment). In one embodiment, when in an initial startup mode, the control unit 40 powers on the motor in the active position (e.g., in contact with the fan drive gear) and designates this motor to be the engaged fan motor.

In step 420 of the present embodiment, control unit 40 begins to monitor the speed of fan 11 after waiting a suitable time to let the engaged fan motor come to its rated speed. Comparator 47 tests the measured data against predetermined threshold data stored in memory 48 for the motors in the fan motor assembly 100. In one embodiment, control unit 40 periodically checks the speed and the current drain of the working fan motor according to a pre-determined interval actuated by controller 50. In one embodiment, this rate is once per second, but any rate suitable for the application may be used in embodiments of the present invention.

In step 430 of the present embodiment, a logical operation is performed in which comparator 47 tests the measured data against predetermined threshold data stored for these motors. If the measured data is within acceptable parameters, flow chart 400 returns to step 420. However, upon detection of a threshold event, such as a decrease in motor speed below a specified level, an increase/decrease in current drain above/below a specified level, or a combination of these two events, flow chart 400 proceeds to step 440. In embodiments of the present invention, the predetermined threshold data is stored in memory 48.

In step 440 of the present embodiment, controller 50 receives a signal from comparator 47 indicating that a failure of the current fan drive motor subassembly has occurred or is imminent.

In step 450 of the present embodiment, controller 50 commands power control subsystem 49 to turn off the power to the engaged motor.

In step 460 of the present embodiment, controller 50 commands power control subsystem 49 to activate the replacement motor in a transport mode, thus moving the fan motor gear against the transport guide, and thereby moving the fan motor subassembly 20 from a first position to a second position, thus bringing the replacement motor drive gear into contact with the fan drive gear. Alternatively, a separate motor coupled with shaft 23 may be used to rotate fan motor subassembly 20 so that the replacement motor is rotated into an engaged position with the fan drive gear.

In step 470, if the replacement fan motor is in the proper position to supply drive to the fan drive gear, controller 50 initiates a command to power control subsystem 49 to activate the desired level of power to motor 212 to drive fan 11 at an appropriate speed. The control unit 40 then begins monitoring the performance of the replacement motor. In embodiments of the present invention, controller 50 sends a status report to a remote monitoring system informing it of a failure in a motor in fan motor assembly 100. In embodiments of the present invention, if the proper position of fan motor subassembly 20 is not validated, controller 50 sends an alarm via connection 421 to, for example, a LAN.

Optionally, if the replacement motor is not correctly positioned, or otherwise fails to provide power to fan 11, controller 50 may be programmed to initiate another replacement process, and move a third motor into position, and seek confirmation that this step is completed and the third motor is in proper position. This optional process can continue until all motors of fan motor subassembly 20 have been moved into position. If none of the motors can provide power to fan 11, indicating a mechanical failure, a signal and status report are generated by controller 500 and sent via connection 241.

Figure 5:
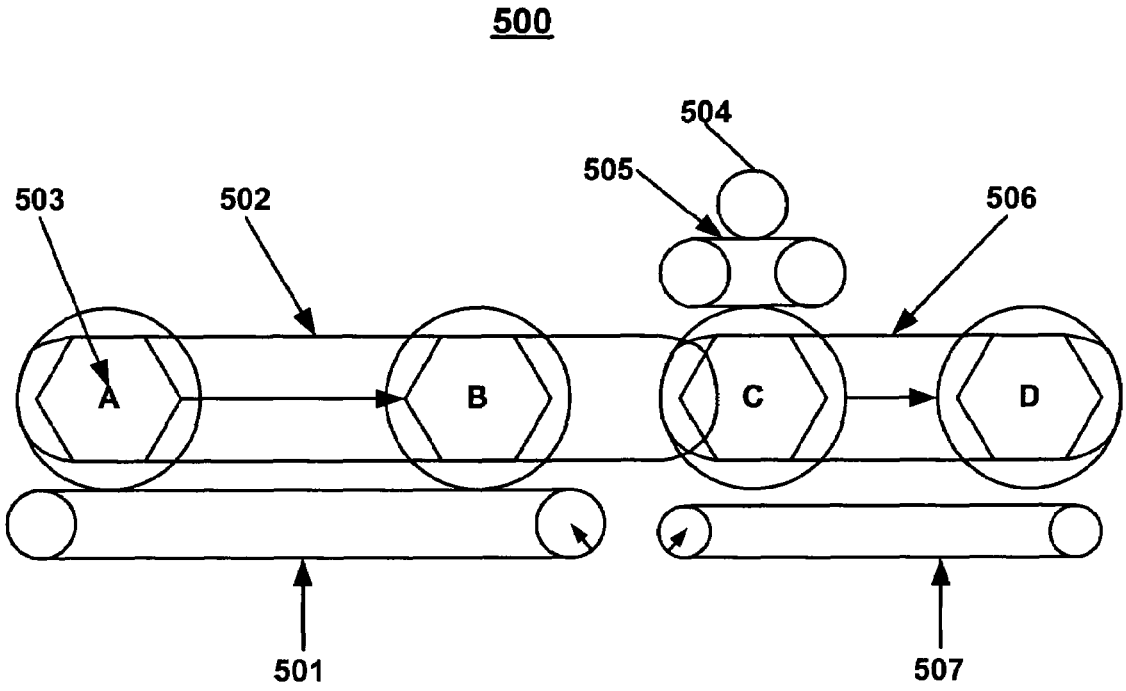
FIG. 5 is a diagram of an integrated redundant fan motor system in accordance with embodiments of the present invention.

FIG. 5 is a diagram of another embodiment of an integrated redundant fan motor system 500 in accordance with embodiments of the present invention. In FIG. 5, a fan drive motor belt 501 is coupled to a fan motor transport belt 502. Fan motor transport belt 502 moves a first fan motor selected from a pool 503 of fan motors stored at initial position A to intermediate position B and drive position C from which the first fan motor drives fan blade gear 504 (e.g., via fan blade belt 505). In one embodiment, a failed fan motor transport belt 506 can be coupled to fan motor transport belt 502 either directly or through a failed motor drive belt 507. In one embodiment, when a failure of the first fan motor is detected at position C, a transport level voltage is applied to a replacement fan motor from pool 503 located at position A. The replacement fan motor powers the above described set of belts and gears which moves the failed first fan motor from location C to location D. Simultaneously, the replacement fan motor also moves itself from position A to position B. At position B, the failed fan motor transport belt 506 is disengaged from fan drive motor 501 because at this point, the voltage applied to the replacement fan motor is increased, thereby increasing the speed of the replacement fan motor and building up momentum to move the replacement fan motor from position B to position C where the replacement fan motor engages fan blade belt 505.

An integrated redundant fan motor system configured to provide a high availability fan system has been described. While the present invention has been described in particular embodiments, it should be appreciated that the present invention should not be construed as limited by such embodiments, but rather construed according to the following claims.

What is claimed is:

1. A fan motor assembly with integrated redundant availability, said fan motor assembly comprising:

a fan motor subassembly comprising a plurality of replaceable fan motors;

a fan motor selector mechanism coupled to said fan motor subassembly, said fan motor selector mechanism configured to selectively engage one of said plurality of replaceable fan motors to a fan; and a control unit coupled to said fan motor selector mechanism, said control unit configured to control said fan motor selector mechanism such that a first of said plurality of replaceable fan motors mechanically powers said fan while a second of said plurality of replaceable fan motors can be dynamically removed from said fan motor subassembly.

2. The fan motor assembly of claim 1 wherein said second of said plurality of replaceable fan motors causes said fan motor subassembly to move from a first position to a second position wherein said second of said plurality of fan motors is engaged to said fan.

3. The fan motor assembly of claim 1 wherein said first of said plurality of replaceable fan motors and said second of said plurality of replaceable fan motors comprise a redundant power source.

4. The fan motor assembly of claim 1 wherein said control unit further comprises:

a fan motor performance monitoring unit configured to determine a performance characteristic of said first of said plurality of replaceable fan motors and said second of said plurality of replaceable fan motors.

5. The fan motor assembly of claim 4 wherein said fan motor performance monitoring unit comprises:

a tachometer configured to determine the rotational speed at which said first of said plurality of replaceable fan motors causes said fan to rotate;

a current measuring device configured to determine the amount of current used by said first of said plurality of replaceable fan motors; and a comparator configured to compare a measured performance characteristic of said first of said plurality of replaceable fan motors with a specified fan motor performance requirement.

6. The fan motor assembly of claim 1 wherein said first of said plurality of replaceable fan motors and said second of said plurality of replaceable fan motors exhibit different power characteristics.

7. The fan motor assembly of claim 6 wherein said control unit can be programmed to selectively engage one of said plurality of replaceable fan motors with said fan.

8. A fan motor assembly configured to provide integrated redundant fan motor availability, said fan motor assembly comprising:

a fan motor subassembly comprising a first replaceable fan motor and a second replaceable fan motor;

a fan motor selector mechanism coupled to said fan motor subassembly, said fan motor selector mechanism configured to selectively dispose said first replaceable fan motor or said second replaceable fan motor in an orientation for driving a fan;

a control unit coupled to said fan motor selector mechanism, said control unit configured to control said fan motor selector mechanism such that said first replaceable fan motor is disposed in said orientation for mechanically driving said second replaceable fan motor can be removed from said fan motor subassembly.

9. The fan motor assembly of claim 8 said second replaceable fan motor causes said fan motor subassembly to move from a first position to a second position wherein said second replaceable fan motor is engaged to said fan and said first replaceable fan motor is simultaneously disengaged from said fan.

10. The fan motor assembly of claim 8 wherein said first replaceable fan motor and second replaceable fan motor comprise a redundant power source for said fan motor assembly.

11. The fan motor assembly of claim 8 wherein said control unit further comprises:

a fan motor performance monitoring unit configured to determine a performance characteristic of a first fan motor removably coupled to said first fan motor receptacle.

12. The fan motor assembly of claim 11 wherein said fan motor performance monitoring unit comprises:

a tachometer configured to determine the rotational speed at which said first of said plurality of replaceable fan motors causes said fan to rotate;

a current measuring device configured to determine the amount of current used by said first of said plurality of replaceable fan motors; and a comparator configured to compare a measured performance characteristic of said first of said plurality of replaceable fan motors with a specified fan motor performance requirement.

13. The fan motor assembly of claim 8 wherein said first replaceable fan motor and said second replaceable fan motor exhibit different power characteristics.

14. The fan motor assembly of claim 13 wherein said control unit programmably selectively engages one of said first replaceable fan motor and second replaceable fan motor with said fan.

15. A method for providing redundant availability in a fan system, said method comprising:

coupling a first replaceable fan motor and a second replaceable fan motor in a fan motor subassembly disposed in a first orientation for driving a fan with said first fan motor;

monitoring a performance characteristic of said first fan motor;

comparing a measured performance characteristic of said first fan motor with a specified fan motor performance requirement; and provided said measured performance characteristic of said first fan motor does not meet said specified fan motor performance requirement, automatically disposing said fan motor subassembly in a second orientation for mechanically driving said fan with said second fan motor while simultaneously disposing said first replaceable fan motor in a position wherein it can be removed from said fan motor subassembly.

16. The method for providing redundant availability in a fan system as recited in claim 15 further comprising utilizing said second replaceable fan motor to drive said fan motor subassembly to said second orientation.

17. The method for providing redundant availability in a fan system as recited in claim 15 wherein said monitoring of said performance characteristic of said first fan motor comprises an current measuring device to determine the amount of current used by said first fan motor.

18. The method for providing redundant availability in a fan system as recited in claim 15 wherein a control unit coupled with a fan motor selector mechanism can be programmed to select said second replaceable fan motor.

19. The method for providing redundant availability in a fan system as recited in claim 15 wherein said control unit is programmed to conform to a logic scheme which defines motor engagement rules that are based upon monitoring sensor input.

* * * * *

UNITED STATES PATENT AND TRADEMARK OFFICE

CERTIFICATE OF CORRECTION

PATENT NO. : 7,322,799 B2
APPLICATION NO. : 10/699430
DATED : January 29, 2008
INVENTOR(S) : Naysen J. Robertson et al.

It is certified that error appears in the above-identified patent and that said Letters Patent is hereby corrected as shown below:

In column 8, line 43, after “motor” insert -- belt --.

In column 9, line 53, in Claim 8, after “said” insert -- fan while said --.

In column 9, line 56, in Claim 9, after “claim 8” insert -- wherein --.

In column 10, line 5, in Claim 11, delete “said” and insert -- a --, therefor.

In column 10, line 24, in Claim 14, after “and” insert -- said --.

Signed and Sealed this

Second Day of September, 2008

JON W. DUDAS
*Director of the United States Patent and Trademark Office*